US010502027B2

(12) United States Patent
Horwell

(10) Patent No.: US 10,502,027 B2
(45) Date of Patent: Dec. 10, 2019

(54) OIL FIELD TUBULAR AND AN INTERNAL SLEEVE FOR USE THEREWITH, AND A METHOD OF DEACTIVATING A FLOAT VALVE WITHIN THE OIL FIELD TUBULAR

(71) Applicant: SWITCHFLOAT HOLDINGS LIMITED, Inglewood (NZ)

(72) Inventor: Mark Graham Horwell, Inglewood (NZ)

(73) Assignee: Switchfloat Holdings Limited, Inglewood (NZ)

( * ) Notice: Subject to any disclaimer, the term of this patent is extended or adjusted under 35 U.S.C. 154(b) by 229 days.

(21) Appl. No.: 15/506,950

(22) PCT Filed: Aug. 25, 2015

(86) PCT No.: PCT/NZ2015/050118
§ 371 (c)(1),
(2) Date: Feb. 27, 2017

(87) PCT Pub. No.: WO2016/032342
PCT Pub. Date: Mar. 3, 2016

(65) Prior Publication Data

US 2017/0254179 A1 Sep. 7, 2017

(30) Foreign Application Priority Data

Aug. 27, 2014 (NZ) ..... 629539
Jan. 7, 2015 (NZ) ..... 703637

(51) Int. Cl.
*E21B 34/14* (2006.01)
*E21B 43/10* (2006.01)
(Continued)

(52) U.S. Cl.
CPC ..... *E21B 34/14* (2013.01); *E21B 21/10* (2013.01); *E21B 34/102* (2013.01); *E21B 43/10* (2013.01); *E21B 2034/005* (2013.01)

(58) Field of Classification Search
CPC .. E21B 2034/005; E21B 21/10; E21B 34/102; E21B 34/14; E21B 43/10
See application file for complete search history.

(56) References Cited

U.S. PATENT DOCUMENTS 2,162,578 A 6/1939 Hacker
2,447,842 A 8/1948 Cameron et al.
(Continued)

OTHER PUBLICATIONS

International Search Report, PCT/NZ2015/050118, dated Dec. 16, 2015.

*Primary Examiner* — Caroline N Butcher
(74) *Attorney, Agent, or Firm* — Merchant & Gould P.C.

(57) ABSTRACT

An oil field tubular for use as part of a well string, includes a hollow tube that forms a passage, each end of the tube configured for connection to the end of an adjacent string section to form a continuous string; a flapper, integrally connected within the hollow tube so that the flapper can move between an open position where the flapper allows fluids to pass through the hollow tube and a closed position where the flapper closes the passage and prevents passage of fluids therethrough, the flapper spaced away from the end connections of the hollow tube, the hollow tube further including a recess formed into part of the side wall, the flapper and tube configured so that in the open position the flapper locates into the recess.

20 Claims, 8 Drawing Sheets

(51) Int. Cl.

| | |
|---|---|
| ***E21B 21/10*** | (2006.01) |
| ***E21B 34/10*** | (2006.01) |
| *E21B 34/00* | (2006.01) |

(56) References Cited

U.S. PATENT DOCUMENTS

| | | | | |
|---|---|---|---|---|
| 3,066,693 | A | 12/1962 | Taylor | |
| 3,071,151 | A | 1/1963 | Sizer | |
| 3,275,080 | A | 9/1966 | Nelson et al. | |
| 3,318,387 | A | 5/1967 | Jones | |
| 4,427,071 | A | 1/1984 | Carmody | |
| 5,823,265 | A | 10/1998 | Crow et al. | |
| 5,862,864 | A | 1/1999 | Whiteford | |
| 6,575,249 | B2 | 6/2003 | Deaton | |
| 7,360,600 | B2 | 4/2008 | MacDougall et al. | |
| 7,677,304 | B1 | 3/2010 | Smith | |
| 2008/0210431 | A1 | 9/2008 | Johnson et al. | |
| 2009/0242213 | A1* | 10/2009 | Braddick | E21B 43/105 166/384 |
| 2011/0048742 | A1 | 3/2011 | Smith et al. | |
| 2012/0148615 | A1* | 6/2012 | Masignani | C07K 14/285 424/190.1 |
| 2016/0032669 | A1* | 2/2016 | Churchill | E21B 34/14 175/40 |

* cited by examiner

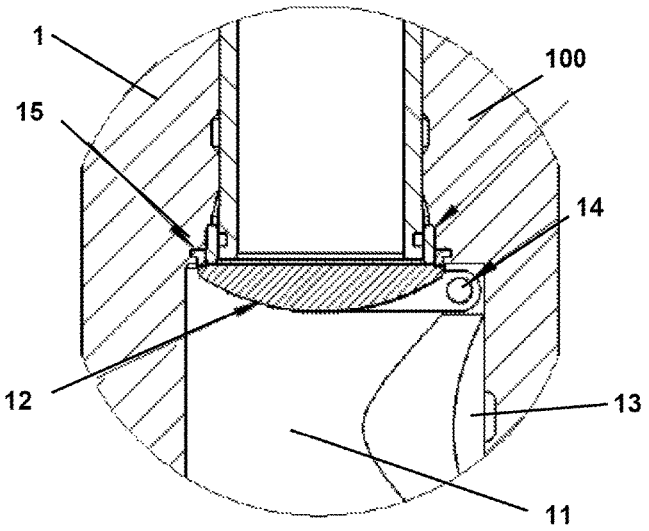
Figure 2
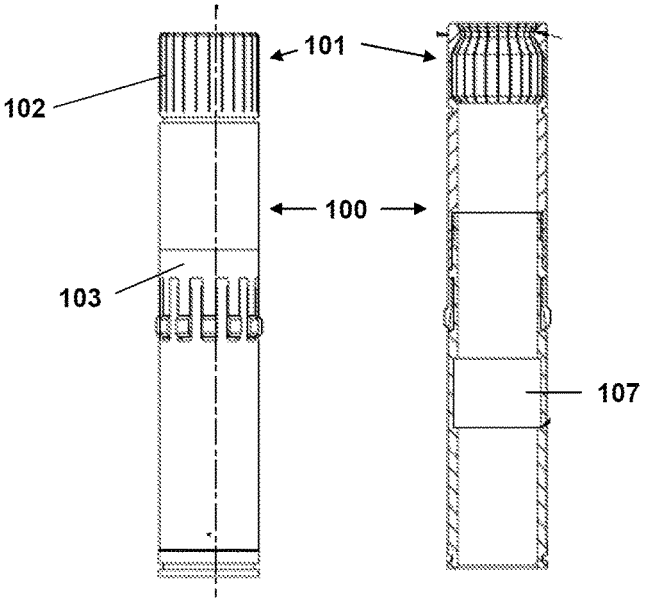
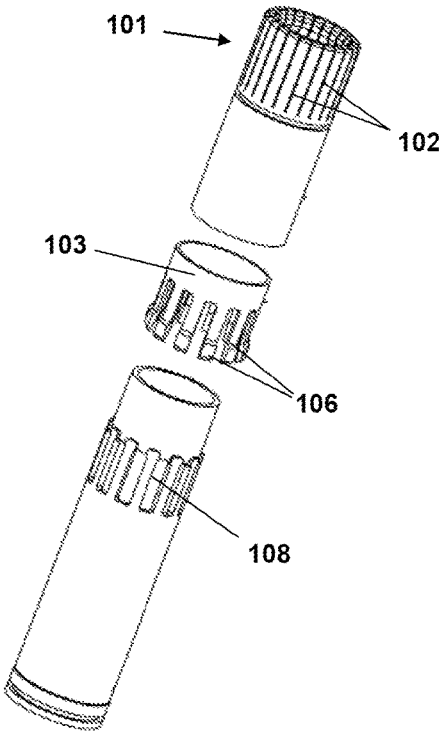
Figure 3a Figure 3b Figure 3c

OIL FIELD TUBULAR AND AN INTERNAL SLEEVE FOR USE THEREWITH, AND A METHOD OF DEACTIVATING A FLOAT VALVE WITHIN THE OIL FIELD TUBULAR

FIELD OF THE INVENTION

This invention relates to an oil field tubular. The present invention also relates to an internal sleeve for use with an oil field tubular. The present invention also relates to a method of deactivating a float valve within an oil field tubular.

BACKGROUND OF THE INVENTION

Drill strings or well strings generally consist of a number of tubular sections (oil field tubulars) connected end-to-end. For some operations and layouts, one-way valves (known in industry as float valves) may be inserted within the well string, for example to allow flow down the string but not up the string. When operational, these valves open to allow fluid to be pumped down the drill string, and close when fluid flow down the drill string stops or if there is reverse flow up the drill string. A higher pressure below the float valve holds the valve closed and fluid or gas is therefore prevented from migrating back up the drill string.

In some situations it may be necessary to convey objects down the drill string on wireline, for example when the drill string has become stuck in the well or when directional surveys are required on wireline. Standard float valves are a barrier in the drill string that prevent wireline access. In stuck pipe scenarios standard float valves add significant difficulty to wireline operations necessary for pipe recovery operations. For directional surveys on wireline the drill string needs to be tripped to surface to remove the standard float valves before wireline operations can begin, this adds significant time and cost to drilling operations. In other situations it may be desirable to deactivate float valves in the drill string to allow reverse circulation.

For the above reasons, at certain times it is desirable to be able to remove the obstruction created by float valves in the drill string. One such device that achieves this is described in WO2014042541. A B-shifting tool assembly is conveyed on slickline that engages a sleeve above a standard float valve and shifts the sleeve into the throat of the valve. A clear path is created allowing tools to be safely conveyed through the valve. Conveying tools on a slickline requires specialist tools that require a specialist slickline contractor to operate. Worn parts or incorrect slickline operation pose a risk in that the slickline tools can prematurely release from the sleeve and become stuck in the float valve. Additional time-consuming operations are required to remedy this situation.

The device described in WO2014042541 utilises a standard float valve. The float valve is contained within a drill string sub, hence the outer diameter of the valve is limited by the geometry allowable through the drill string connection. This in turn limits the diameter of the sleeve that positions within the float valve. The resulting internal diameter of the valve is in some cases too small to allow necessary tools to be conveyed through the valve. The limited ID is also a restriction to flow through the drill string.

It is an object of the present invention to provide a drill string element that helps to overcome the above disadvantages, or which at least provides the public or industry with a useful choice. It is a further object of the present invention to provide an internal sleeve for use with a drill string that helps to overcome the above disadvantages, or which at least provides the public or industry with a useful choice. It is a yet still further object of the present invention to provide a method of activating a drill string float valve that helps to overcome the above disadvantages, or which at least provides the public or industry with a useful choice.

STATEMENTS OF INVENTION

In a first aspect, the invention may broadly be said to consist in a drill string sub for use as part of a well string, comprising:

- a hollow tube that forms a passage, each end of the tube configured for connection to the end of an adjacent string section to form a continuous string;
- a flapper, integrally connected within the hollow tube so that the flapper can move between an open position where the flapper allows fluids to pass through the hollow tube and a closed position where the flapper closes the passage and prevents passage of fluids therethrough, the flapper spaced away from the end connections of the hollow tube, the hollow tube further comprising a recess formed into part of the side wall, the flapper and tube configured so that in the open position the flapper locates into the recess.

Preferably the recess is formed as substantially the inverse of the outer/lower surface shape of the flapper so that the flapper fits snugly into the recess in a fully open position.

Preferably the flapper is rotationally connected to the tube via an axis at or towards one side of the flapper and at or towards one end of the recess.

Preferably the flapper is hingedly connected to the hollow tube, the hinge formed as a pin that passes through the side wall of the hollow tube, the oil field tubular further comprising threaded plugs that locate at or towards each end of the pin in the side wall of the hollow tube to block the path between the inside and the outside of the hollow tube.

Preferably the perimetrical dimensions of that portion of the hollow tube containing the flapper are greater than the perimetrical dimensions of the adjacent sections of the hollow tube.

Preferably the smallest outer dimension of the flapper and the perimetrical dimension of the adjacent section closest to the end are such that the flapper will only just fit through.

Preferably the drill string sub further comprises an expansion chamber located between the upper end of the hollow tube and the upper end of that portion of the hollow tube containing the flapper.

Preferably the expansion chamber at least partly has the profile of a truncated cone, the narrower end of the cone aligned towards that portion of the hollow tube containing the flapper.

Preferably the wall of the hollow tube between the expansion chamber and the flapper further comprises at least one groove aligned substantially perpendicularly to the centreline of the hollow tubular section.

Preferably the tube and flapper are formed so that with the flapper in the open position the minimum internal diameter of the tubular section is at least 2.3 inches.

Preferably the recess is formed from spark erosion.

In a second aspect the invention may broadly be said to consist in an internal sleeve for use with a drill string sub, comprising:

- a hollow tubular section configured for positioning in an oil field tubular with at least part of the outer surface of the tubular section located against the inner surface of the oil field tubular so that fluid passing along the oil field tubular flows through the hollow tubular section;

a retaining section at or towards one end of the tubular section configured to provide a reduced internal diameter when restrained within the normal internal diameter of the oil field tubular, the retaining section outwardly expandable to at least the internal diameter of the oil field tubular when substantially unrestrained by the normal internal diameter of the oil field tubular.

Preferably the internal sleeve further comprises at least one locking protrusion, associated with the tubular section and movable between opposed positions within and beyond an axially aligned boundary formed by the outer surface of the tubular section, the at least one locking protrusion outwardly biased.

Preferably the at least one locking protrusion is a plurality of protrusions spaced around the perimeter of the tubular section.

Preferably the plurality of protrusions are formed as part of a spring collet configured to locate onto the tubular section.

Preferably the tubular section comprises separate first and second sections each having an end configured for mutual connection so that the first and second sections can be connected end-to-end, each having a flange section towards the common ends, the flange sections spaced so that the spring collet can locate securely between the flange sections.

Preferably the mutually engaging ends are configured as a male end and a female end.

Preferably the tubular section further comprises a retaining projection extending at least partly around the external surface of the tubular section, the retaining projection and the spring collet configured for mutual engagement to prevent axial movement in at least one direction along the tubular section.

Preferably the retaining section comprises a plurality of fingers extending from the upper end of the tubular section, the inner surfaces of the fingers configured to form a reduced internal diameter section when retained in use by the internal diameter of the oil field tubular.

Preferably each of the fingers is configured with a smooth axially aligned outer surface when retained and an inner surface shaped to provide a reduced internal diameter at or towards the upper end of the fingers.

Preferably the inner surface of each of the fingers is further shaped to provide a reduced internal diameter at or towards the inner end of the fingers.

In a third aspect the invention may broadly be said to consist in a well string assembly for use as part of a oil well string, comprising:

a drill string sub according to any one of the preceding statements relating to the first aspect;

an internal sleeve according to any one of the preceding statements relating to the second aspect.

Preferably the well string assembly further comprises a tool having a profile that fits within the internal sleeve, the tool having a larger portion spaced away from the lower end that has a profile larger than the profile of the reduced diameter section, the tool formed in relation to the tubular and sleeve such that in use the lower end of the tool will contact the flapper before the tool contacts the sleeve, and open the flapper at or before the larger portion contacts the upper surface of the reduced diameter section.

Preferably the lower end is profiled to contact the flapper at a point remote from the integral connection.

Preferably the lower end is rounded.

In a fourth aspect the invention may broadly be said to consist in a method of deactivating a series of float valves within an oil field string at least partly formed from a plurality of tubular sections, each section having an internal expansion chamber, and each containing an internal sleeve above the float valve, each sleeve having an expandable reduced diameter section that in the sleeve initial position is located above the expansion chamber, the method comprising the steps of:

(i) choosing a tool having a profile that fits within the internal sleeve but which is greater than the profile of the reduced diameter section;

(ii) passing the tool down the string so that the tool engages with the reduced diameter section of the topmost sleeve and moves the tool and sleeve downwards so that the sleeve engages with the float valve to hold the valve open and the reduced diameter section expands into the expansion chamber.

(iii) subsequently passing the tool downwards through the string to the next lowest sleeve.

Preferably the tool is chosen as one configured so that the tool will open the float valve at or before engaging with the sleeve.

Preferably in the step of passing the tool down the string, the tool is pumped down the string.

Preferably in the step of passing the tool down the string, the tool is a slickline tool conveyed on a slickline.

Preferably in the step of passing the tool down the string, the tool is a wireline tool conveyed on a wireline.

Preferably in the step of passing the tool down the string, the tool is a coil tubing tool.

Preferably the method of deactivating a series of float valves comprises the further step of removing the tool from the string using standard wireline tools.

Preferably the method of deactivating a series of float valves comprises the further step of removing the tool from the string by reverse circulation of fluid up the string.

In a fifth aspect the invention may broadly be said to consist in a method of deactivating a float valve within a drill string sub containing a downwardly movable internal sleeve initially positioned above the float valve, comprising the steps of:

(i) choosing a tool having a profile that fits within the internal sleeve but which is greater than the profile of the reduced diameter section;

(ii) passing the tool down the string so that the tool engages with and opens the float valve;

(iii) continuing to pass the tool down the string so that subsequent to the opening of the float valve, the tool moves the sleeve downwards so that the sleeve engages with the float valve to hold the valve open.

Preferably the tool is chosen as one configured so that the tool will open the float valve at or before engaging with the sleeve.

Preferably in the step of passing the tool down the string, the tool is pumped down the string.

Preferably in the step of passing the tool down the string, the tool is a slickline tool conveyed on a slickline.

Preferably in the step of passing the tool down the string, the tool is a wireline tool conveyed on a wireline.

Preferably in the step of passing the tool down the string, the tool is a coil tubing tool.

Preferably the method of deactivating a series of float valves comprises the further step of removing the tool from the string using standard wireline tools.

Preferably the method of deactivating a series of float valves comprises the further step of removing the tool from the string by reverse circulation of fluid up the string.

In a fifth aspect the invention may broadly be said to consist in a drill string sub for use as part of an oil field string, comprising:

a tubular upper sub and a tubular lower sub having inner ends configured for mutual connection so that a closed internal passage through the subs is formed between the outer ends, the outer ends each configured for connection to the end of an adjacent drill string element;

a tubular housing, configured to locate in use within the closed internal passage, the housing having a housing passage extending therethrough, the housing further comprising a flapper, located in the housing towards the lower end, the flapper hingedly connected to the housing to move between a closed position closing the passage, and an open position;

an internal sliding sleeve configured to fit within the housing and configured to move downwards within the housing from an upper position where the flapper can operate freely to a lower position where the sleeve holds the flapper open.

Preferably the housing is connected with the inner end of the upper sub and sized and shaped to extend within the lower sub from the inner end of the upper sub.

Preferably the housing passage is axially offset.

Preferably the housing is connected with the upper sub below the mutual connection of the upper and lower subs.

Preferably the housing connects with the inner end of the upper sub via a threaded screw fit connection.

Preferably a recess aperture is formed in the side of the housing passage below the flapper, the flapper hingedly connected at one side of the housing passage so that the flapper can swing open from a closed position where the flapper extends across and closes the passage, and an open position where the flapper rotates downwards and sideways into the recess aperture.

Preferably the housing further comprises an expansion chamber located between the upper and lower ends and above the flapper.

Preferably the expansion chamber at least partly has the profile of a truncated cone, the narrower end of the cone aligned towards the flapper.

Preferably the wall of the housing between the expansion chamber and the flapper further comprises at least one groove aligned substantially perpendicularly to the centreline of the hollow tubular section.

Preferably the drill string sub further comprises a cap, the lower end of the housing and the cap configured for mutual connection Preferably the cap and housing are connected via mutual threading.

Preferably the outer end of the upper sub is funneled internally.

Preferably the passage through the upper sub is axially aligned.

Preferably the passage through the lower sub has an upper portion and a lower portion, a recess located in the upper portion and formed to extend around substantially the entirety of the perimeter/internal wall of the central passage.

Preferably the diameter of the lower portion is less than that of the upper portion, an upwardly-facing ridge formed where the upper and lower portions meet.

Preferably the lower end of the lower sub is tapered.

Preferably the inner end of the upper sub is tapered, the inner end of the lower sub funneled to receive the tapered inner end of the upper sub.

Preferably the passage through the lower sub is axially aligned.

Preferred embodiments are set out in the claims and are incorporated in the description by reference.

BRIEF DESCRIPTION OF THE DRAWINGS

The accompanying drawings which are incorporated in and constitute part of the specification, illustrate embodiments of the invention and, together with the general description of the invention given above, and the detailed description of embodiments given below, serve to explain the principles of the invention.

FIG. 2 shows a close-up cutaway front view of the drill string sub and integral float valve, showing detail of a hinge connection between the flapper of the float valve and the drill string sub, and a seal onto which the flapper seats in the closed position;

FIG. 3*a* shows a side view of an embodiment of a sliding sleeve that can be used within the drill string sub of FIG. 1, the sliding sleeve formed from an upper section and a lower section connected end-to-end via a threaded male/female fit (thread not shown), a spring collet located over the connection between the upper and lower sections and held in position by flanges on each of the upper and lower sections, the upper end of the upper section having a plurality of fingers with an outer surface that extends parallel to the outer surface or side of the upper section, in use the inner surface of the fingers forming a reduced internal diameter section when inwardly biased, the fingers expanding outwards from their inwardly biased position when unrestrained, the sleeve in use locating into the drill pipe and movable from an upper to a lower position within the drill pipe, the fingers expanding outwards into the expansion cavity when the sliding sleeve is in the lower position;

FIG. 3*b* shows a cutaway side view of the sliding sleeve of FIG. 3*a;*

FIG. 3*c* shows a perspective view of the sliding sleeve of FIG. 3*a;*

DETAILED DESCRIPTION OF EMBODIMENTS OF THE INVENTION

Embodiments of the drill string sub and internal sleeve of the present invention will now be described, along with a method of use to deactivate the integral float valve in the drill string sub.

First Embodiment

Drill String Sub

Figures 1A, 1B:
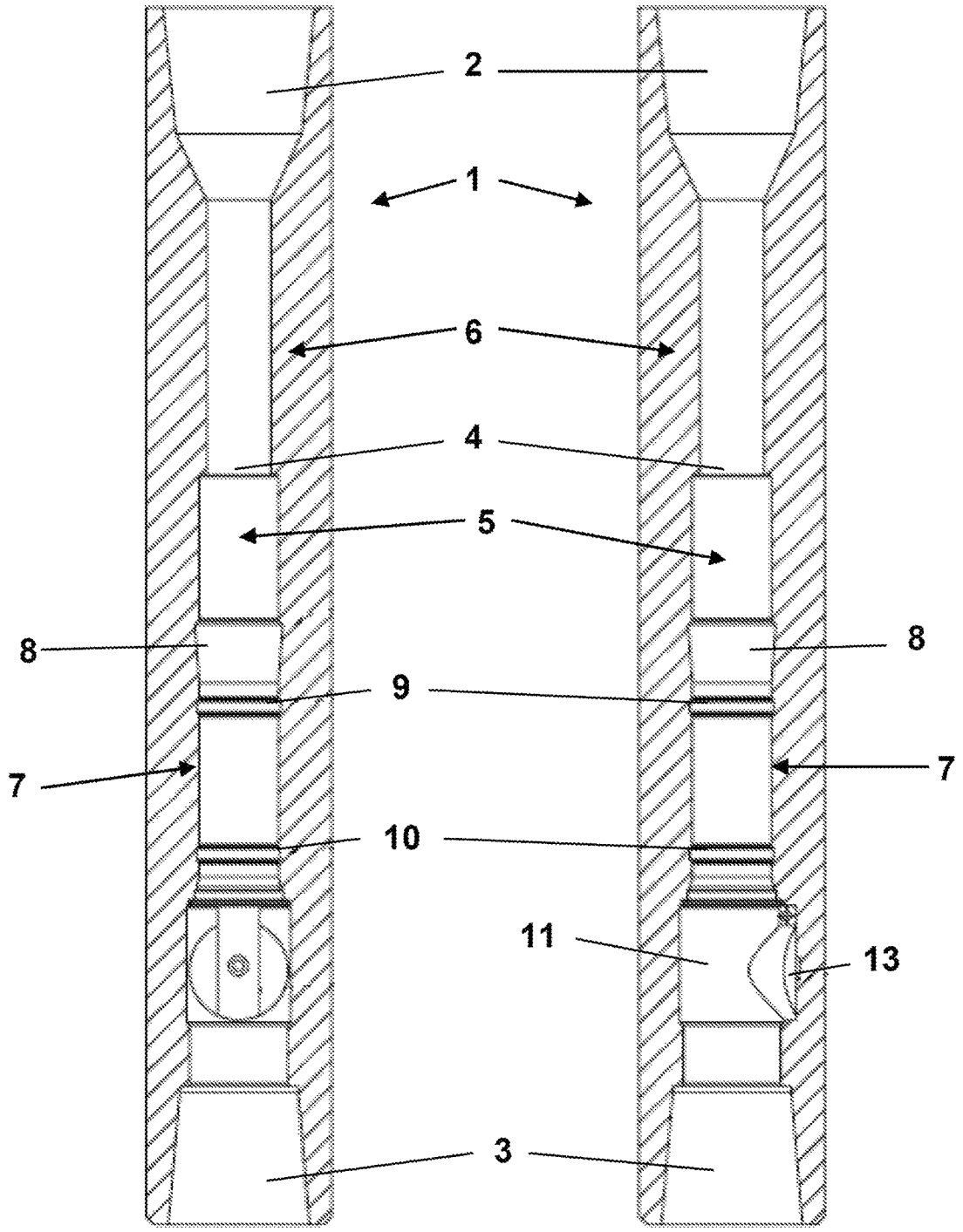
FIGS. 1*a* and 1*b* show cutaway views from the front and the side of a type of oil field tubular known as a drill string sub according to an embodiment of the present invention, the drill string sub forming an element of a drill string, the ends of the drill string sub configured for end-to-end connection to other elements to form a drill string, an integral float valve located in a lower part of the drill string sub and spaced from the lower end, the central section of the drill string sub further configured to receive an internal sliding sleeve, and to allow the sleeve to move within the drill string sub from an upper position where a flapper (not shown) that forms part of the float valve can operate freely and a lower position where the sleeve overlaps with the flapper to hold the flapper open, disabling the float valve, the central section of the drill string sub also having an expansion cavity.

A first embodiment of drill string sub 1 is shown in FIGS. 1*a* and 1*b*. The drill string sub 1 forms one element of a multi-element drill string, specifically the upper sub of an upper/lower sub pair. The drill string sub 1 has the general overall form of a tubular section, with an internal passage 5 through and between upper and lower ends 2, 3. The drill string sub 1 is generally circular when viewed end-on. Each of the upper and lower ends 2, 3 are configured for connection to the end of an adjacent drill string element or item. The lower end 3 of the drill string sub 1 is outwardly flared or funneled (so that it appears conical in cross-section) and internally threaded, and the upper end 2 of the internal passage through the drill string sub is also flared or funneled to receive the tapered lower end of another drill string element immediately above the drill string sub 1. The connection portions at the top and bottom of the sub have approved threaded drill string connections with rated torsional and axial strength.

The central portion of the passage 5, between the funneled ends 2, 3, can be divided into two sub-sections: an upper narrow sub-section 6 and a wider lower sub-section 7. These are described in detail below.

The upper narrower sub-section 6 has an upper end that meets the lower end of the upper end 2, the passage then extending downwards in alignment with the centreline of the drill string sub 1 to meet the upper end of the wider lower sub-section 7. As lower sub-section 7 is wider, a downwardly-facing ridge or shoulder 4 is formed where the common ends of the two sub-sections meet. The wider lower sub-section 7 extends downwards generally in alignment with the centreline of the drill string sub 1. The wider lower sub-section 7 is configured to receive an internal sliding sleeve such as sleeve 100 described in detail below, and to allow the sleeve to move within the drill string sub from an upper position where the upper end of the sleeve 100 seats onto the ridge 4, downwards to a lower position. The wider lower sub-section 7 further comprises an expansion chamber 8 at approximately the mid-height of the wider lower sub-section 7, formed as a wider passage portion having greater perimetrical dimensions than the wider lower sub-section and in side view having the profile of a truncated cone, the narrower end of the cone downwards. An upper perimetrical or circumferential groove 9 and a lower perimetrical or circumferential groove 10 are formed in the side wall and are aligned perpendicularly to the centreline of the drill string sub 1.

It should be noted that although the passage is described as in alignment with the centreline in the description above, the design could also be easily modified so that the passage is axially offset. Offsetting the internal features slightly allows a user to configure the sub as required and allows the sub to be strengthened as and where required.

A recess 11 is formed between the lower end of the lower sub-section 7 and the funneled lower end 3, directly below the lower sub-section 7. The recess 11 is generally aligned with the centre line of the drill string sub 1. However, the recess 11 forms part of an integral float valve assembly in the drill string sub 1 and is formed into part of the side wall so that it is asymmetrical, having a cavity 13 formed at one side, shaped as the inverse of the flapper. That is, the cavity 13 (and by extension the remainder of the associated recess) is particularly shaped to receive the flapper, and is not formed as an eccentric or oversized concentric bore.

The recess is formed by spark erosion as this has been found to allow creation of the relatively complex shape of the recess and to allow operation of the integral float valve, while still allowing the sub to have sufficient strength. The integral float valve assembly has a flapper 12, the flapper 12 connected to the main body of the drill string sub 1 via a hinge 14 at the top end of the cavity 13, to one side of the recess 11. The hinge 14 is formed as a pin that passes through apertures in the side wall of the sub, which are sealed by threaded plugs, in order to block the path between the inside and the outside of the sub, and to seal high pressure inside the sub. The flapper 12 rotates open into the cavity 13, which receives the flapper 12. As outlined above, the recess is machined as substantially the inverse of the outer/lower surface shape of the flapper so that the flapper fits snugly into the recess. It should be noted that using conventional turning techniques to form the recess will not provide sufficient strength to the sub, as the wall thickness will not be sufficient to accommodate the hinge pin, plugs, and other necessary items. In the open position, in the cavity 13, the flapper 12 is clear of the main path or passage through the drill string sub 1. The upper end of the recess 11 has wider outer dimensions than those of sub-section 7 directly above, and in the closed position the flapper 12 seats onto the shoulder formed between the upper end of the recess 11 and the lower end of sub-section 7, a seal 15 located in/on the shoulder for the flapper 12 to contact to assist with sealing. A short section of passage below the recess 11 spaces the recess 11 away from the lower end 3, which is threaded for connection to another element below the drill string sub 1. The flapper is passed through the connection at the lower end to be integrally connected to the sub. The smallest outer dimension of the flapper in this embodiment only just fits through the inner diameter of the connection.

In this embodiment, the drill string sub 1 is used with a drill string having a nominal size of 5 inches. The outer diameter of the drill string sub 1 is 6⅝", as this is the maximum outer diameter of the connection used with most 5" drill strings. Depending on the particular application or situation, the outer diameter and the inner diameter are both subject to many contributing factors. However, in this embodiment, the drill string sub is used with a 5" drill string and has an ID of substantially 2.3" with the flapper 12 in the open position. The OD and ID could be easily changed slightly within the 5" drill string design, or scaled to suit other drill string sizes.

In general, ideally the drill string sub will be stronger than the drill pipe that it is being utilised with, so that it is not the weak point in the drill string. The geometry around the float valve components needs to allow for suitable strength to suit the particular drill string the sub is being used with. The thickness of the sleeve utilised with the switchfloat valve can be reduced slightly to increase the ID through the valve too. With the 5" drill string design described for the preferred embodiment, the ID is 2.3" as this gives enough clearance to run 2.25" tools through the valve. Most tools likely to be used are smaller than this. This also gives good wall thickness in the sleeve, which should extend the life of the sleeve when compared to a thinner walled sleeve.

There are many contributing factors that govern the ID that can be achieved through the Switchfloat valve. However, the design of this invention allows for a larger ID than previous designs such as are known in the art.

Internal Sleeve

An embodiment of internal sleeve 100 suitable for use with the drill string sub 1 is shown in FIGS. 3*a*-3*c*.

The sleeve 100 is formed as a hollow tubular section sized and shaped to fit into the wider sub-section 7 of the drill string sub 1, so that fluid can pass through and along the drill string sub 1 through the sleeve 100. The main body of the sleeve 100 has outer dimensions so that it fits snugly and is a sliding fit within the wider sub-section 7.

In the preferred embodiment, the main body of the sleeve 200 is formed from separate first (lower) and second (upper) sections each having an end configured for mutual connection so that the first and second sections can be connected end-to-end, the mutually engaging ends configured as a male end and a female end.

A retaining section 101 is formed at or towards the upper end of the second section and is configured to provide a reduced internal diameter when restrained within wider sub-section 7—that is, when restrained it provides an internal diameter narrower than that of the narrow subsection 6. When unrestrained, the retaining section 101 expands outwards so that the minimum ID of the entire sleeve is at least the internal diameter of the narrow sub-section 6. The retaining section 101 in the preferred embodiment comprises a plurality of fingers 102 extending from the upper end of the main body of the sleeve 100. The inner surfaces of the fingers 102 are configured to form a reduced internal diameter section when retained. Each of the fingers 102 has a smooth axially aligned outer surface when retained and an inner surface at or towards the outer end of the fingers that is profiled to provide the reduced internal diameter.

The sleeve 100 further comprises a spring collet 103 configured to locate onto the body of the sleeve 100, approximately halfway along the length/height of the sleeve 100.

The spring arms 106 of the collet 103 interlock with a number of cut-out sections 108 on the lower section and are movable/bendable between two opposed positions: the first within the boundary formed by the outer surface of the lower section and the second outwardly beyond this boundary. The spring arms 106 are outwardly biased. The parts that form the sleeve 100 are intended for multiple uses or multiple re-uses.

The sleeve 100 has a recess 107 formed in the lower section to allow slickline B-shifting tools to engage with the sleeve. This allows the sleeve to be installed at surface in a drill pipe that forms an upper sub, and also can be used to move the sleeve upwards in use to re-activate the float valve assembly in the drill string sub 1 when the tool is down hole.

Figure 4A:
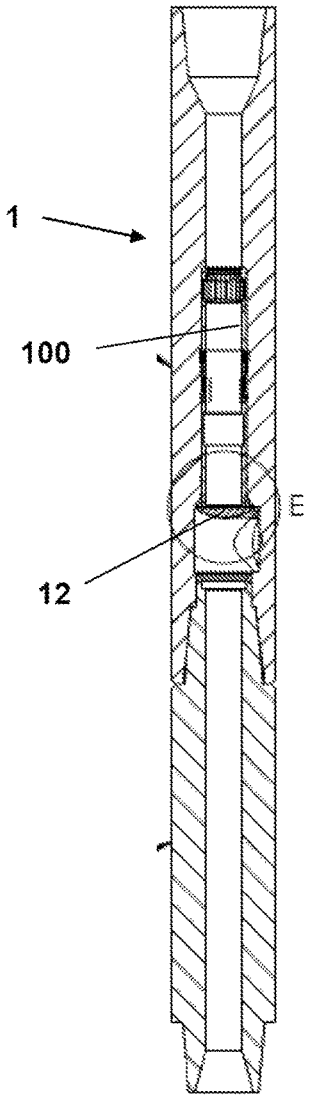
FIGS. 4*a*-4*c* show cutaway views from the same angle as FIG. 1*b* of the drill string sub, the float valve assembly and the sliding sleeve of FIGS. 1-3 assembled, the sleeve shown in the upper position in FIG. 4*a* with the float valve below the sleeve able to operate freely and with the flapper shown in a closed position, FIG. 4*b* showing a tool being pumped or lowered down the drill string to engage with the sleeve and move this downwards, FIG. 4*c* showing the sleeve in the lower or downwards position to hold the flapper open and disable the float valve, the reduced diameter section of the sleeve shown co-located with the expansion chamber of the drill pipe so that the fingers of the reduced diameter section can expand or deform into the expansion.

In use, the drill string sub 1 and internal sleeve 100 are assembled as shown in FIG. 4*a*. The sleeve 100 is in the upper position so that the flapper 12 can freely open and close, with the outer ends of the protrusions of the spring collet 103 locating into the upper groove 9. Fluid can pass freely down the drill string through the drill string sub 1 and sleeve 100. The float valve activates to prevent fluid from moving up the drill string.

Figure 4B:
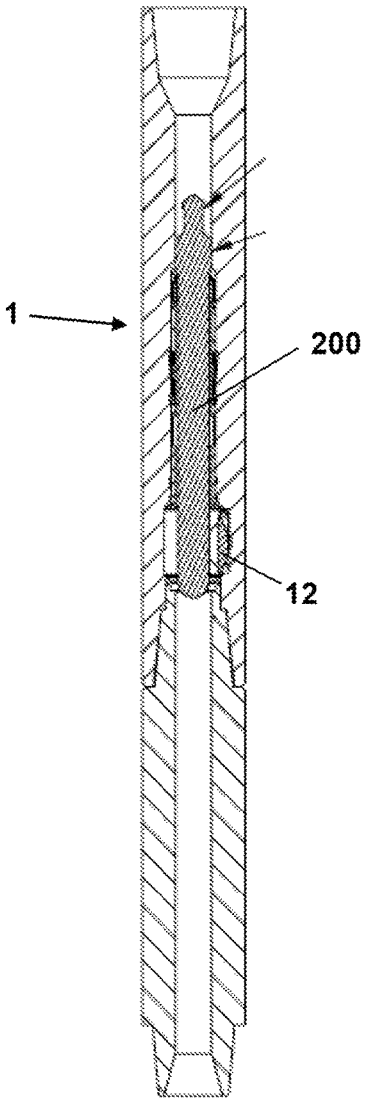
Figure 4C:
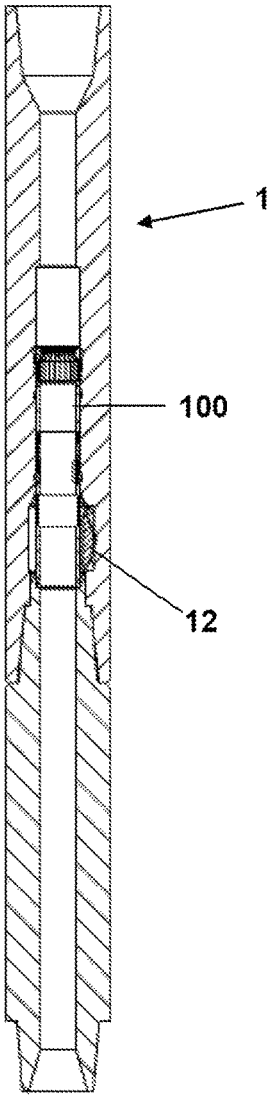

When it is desired to deactivate the float valve, a tool such as the dart 200 shown in FIG. 4*b* is pumped down the drill string. The dart is designed to be pumped down the string, which inherently opens the flapper and equalises pressure across the valve. The dart is designed to contact with the flapper and hold the flapper open while the sleeve is shifted into position to hold the flapper open.

The lower part of the dart 200 enters the sleeve, and pushes the flapper open from the middle of the flapper. The dart 200 contacts the flapper and holds the flapper open while the sleeve is shifted into the throat of the valve. Having a lower end that contacts the flapper away from the pin or hinge is advantageous as this helps to prevent damage to the pin by putting less loading on the pin, in comparison to contact from the sleeve, which would contact the flapper close to the pivot point of the flapper. The lower end of the dart 200 is rounded to help ensure this distancing. Pumping the dart down the drill string also ensures that pressure is equalized across the float valve and allows the flapper to open. The fact that the dart (or other actuation tool) opens the flapper before shifting the sleeve helps to ensure much better reliability of the tool, and helps to prevent damage to the flapper pin. Pumping the dart down the string inherently opens the flapper and helps to equalise pressure across the valve.

Subsequent to this, a wider collar section of the dart 200 engages with the retaining section 101. As pressure is maintained above the dart 200, this exerts downwards force on the sleeve 100, overcoming the retaining force provided by the engagement of the spring collet 103 and groove 9 so that the sleeve 100 starts to move downwards. At around this point, the fingers 102 of the retaining section 101 are co-located with the expansion chamber 8 and move outwards into the expansion cavity 8 so that the size of the passage through the sleeve is now greater than the outer diameter of the actuating dart 200. The dart 200 is then able to travel further down the drill string and actuate/open further switchfloat valves in the drill string. With all the valves in the drill string open there is now a clear path for tools to be conveyed down the drill string.

The dart 200 has a fishing neck at its upper end so as it can be removed from the drill string using standard wireline fishing/overshot tools. A 'catcher sub' (not shown) can be used below the switchfloat subs. The catcher sub catches and positions the dart so that it is easily latched and retrieved with wireline/slickline tools after use. The catcher sub has bypass channels around it so that the dart can sit in the sub and fluid can still be pumped down the drill string.

The dart can also be recovered by reverse circulation if it is being used in a string where there are no other float valves below the switchfloat valves.

The sleeves can also be shifted downwards using slickline tools, if the fluid pumping method outlined above is not possible. The slickline tools cannot pass through the valve until the sleeve is shifted down, so it is not possible for the slickline tools to prematurely release from the sleeve. Coil tubing and other methods of conveying tools down a drill string can also be used as alternatives.

The tool used to deactivate the float valve(s) could also be a ball, pumped down through the drill string to actuate/open the switchfloat valves in the drill string, in a similar manner to that described above for the dart 200.

The deactivation ball would have a diameter slightly smaller than the internal diameter of the main part of the sleeve 100, but larger than that of the upper end of the retaining section 101. As the ball is pumped down the well string, the ball engages with the upper end of the retaining section 101. As pressure is maintained above the ball, this exerts downwards force on the sleeve 100, overcoming the retaining force provided by the engagement of the spring collet 103 and groove 9 so that the sleeve 100 starts to move downwards. After the sleeve 100 has moved down a certain distance, the fingers 102 of the retaining section 101 are co-located with the expansion chamber 8 and move outwards into the expansion chamber 8, allowing the ball to travel through the sleeve 100, downwards through the drill string. Once the deactivation ball reaches the bottom of the drill string, it can be held in a catcher sub, or simply remain within the drill string, until tripping out of the hole. This eliminates the need to recover the actuation tool.

It should be noted that the dart could be formed from a dissolvable material. In use, a dissolvable dart would be pumped through the drill string to actuate/open the switchfloat valves in the drill string, in the same manner as described above for dart 200. When the dissolvable dart reaches the bottom of the drill string and all the valves in the drill string are open, the dart will remain in position and will dissolve so as to allow unimpeded use of the drill string.

In a similar fashion, the deactivation ball could be formed from a dissolvable material. pumped through the drill string to actuate/open the switchfloat valves in the drill string, in the same manner as described above for dart 200 and the dissolvable dart. On reaching the bottom of the drill string, the dissolvable ball will remain in position and dissolve so as to allow unimpeded use of the drill string.

Using dissolvable materials eliminates the need to recover the actuation tool. Once the tool has dissolved, no debris is left in the well that might block the drill string or otherwise impede use, and clogging or blockage is prevented.

Second Embodiment

Drill String Sub

Figure 5:
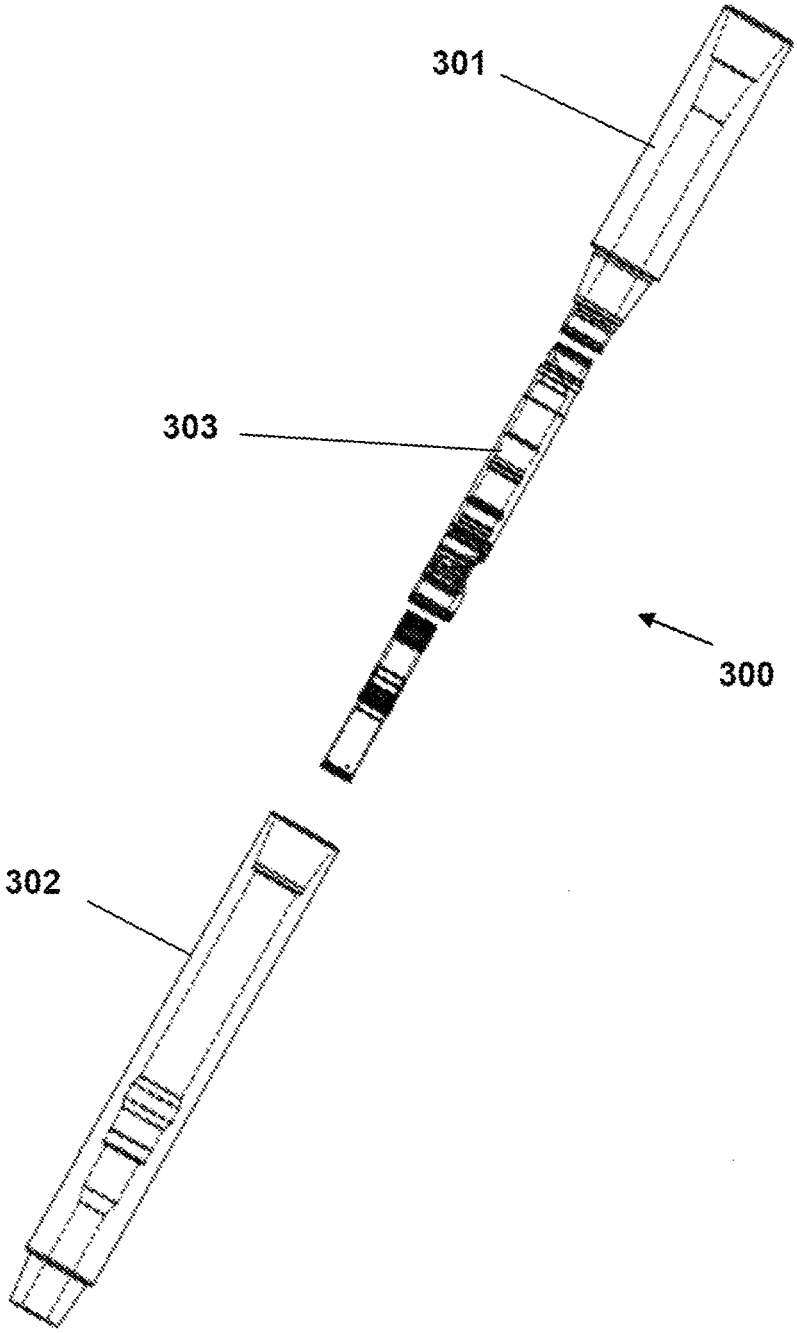
FIG. 5 shows an exploded cutaway view of a second embodiment of drill string sub assembly, the drill string sub assembly made up of a top or upper sub, a bottom or lower sub, and a housing, the upper and lower subs connecting in use with the housing located between and inside the upper and lower subs, the housing having a flapper that rotates open and closed to act as a float valve towards the lower end, the bottom sub having an expansion cavity into which the flapper rotates when in the open position, the housing containing an internal sliding sleeve that in use can move within the drill string sub from an upper position where the flapper can operate freely to a lower position where the sleeve overlaps with the flapper to hold the flapper open.
Figure 6A:
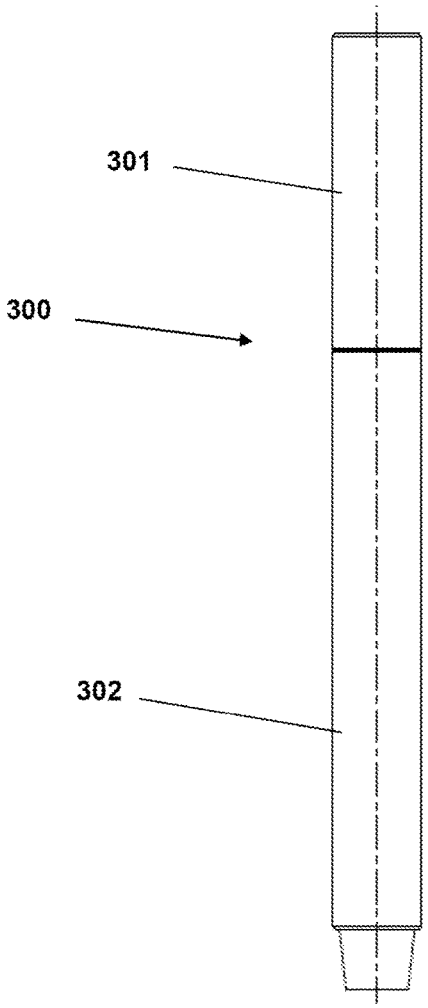
FIGS. 6*a* and 6*b* show a side view and a cutaway side of the upper and lower subs and housing of FIG. 5 as assembled and ready for use, the flapper rotated halfway between the open and closed positions.
Figure 6B:
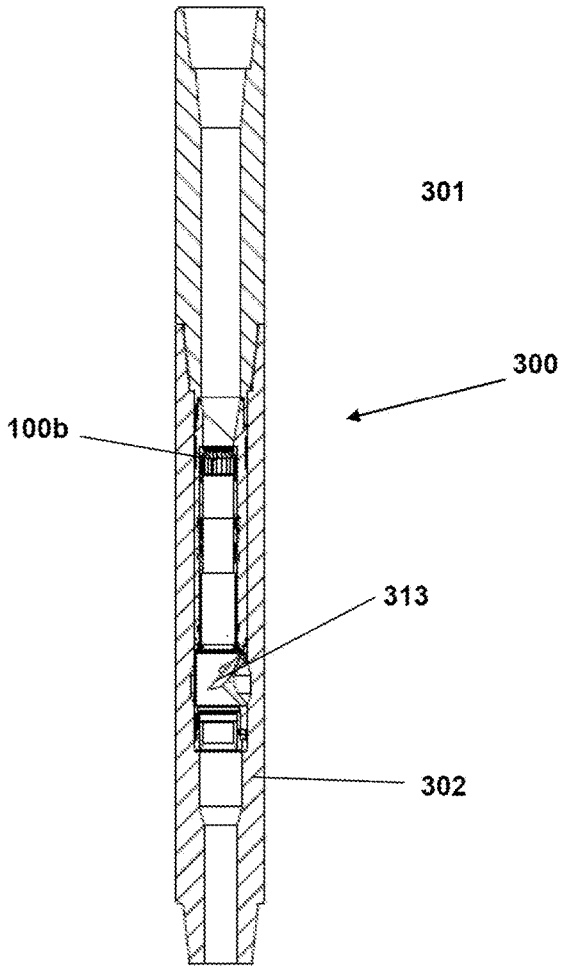

A second embodiment of drill string sub 300 is shown in FIGS. 5 and 6. The drill string sub 300 is formed from three main parts: an upper sub 301, a lower sub 302, and a housing 303. When assembled, the drill string sub 300 forms one element of a multi-element drill string, and has the general overall form of a tubular section, with an internal passage through and between the upper and lower ends. The drill string sub 300 is generally circular when viewed end-on. Each of the upper and lower ends are configured for connection to the end of an adjacent drill string element or item.

Upper Sub

Figure 7A:
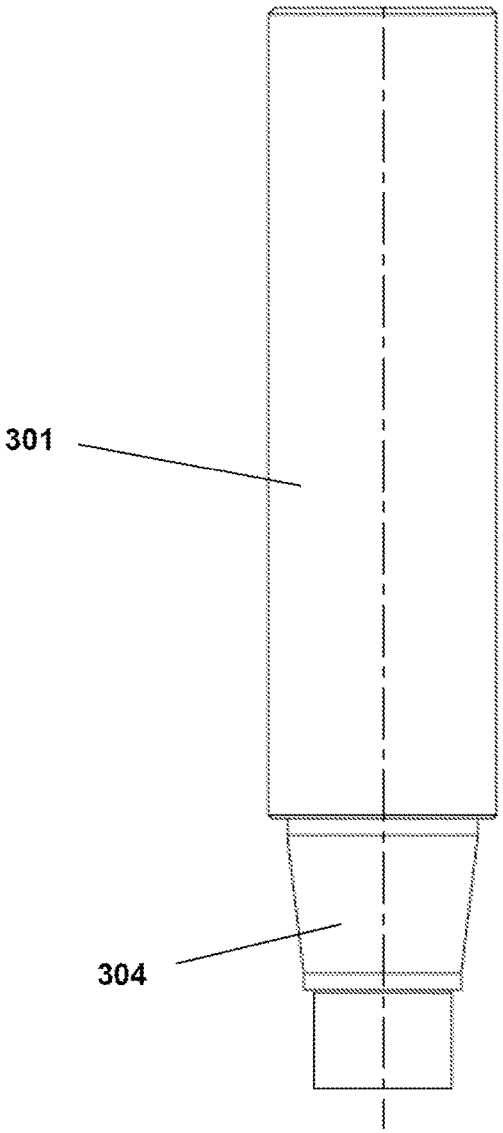
FIGS. 7*a* and 7*b* show a side view and a cutaway side view respectively of the upper sub of FIGS. 5 and 6.
Figure 7B:
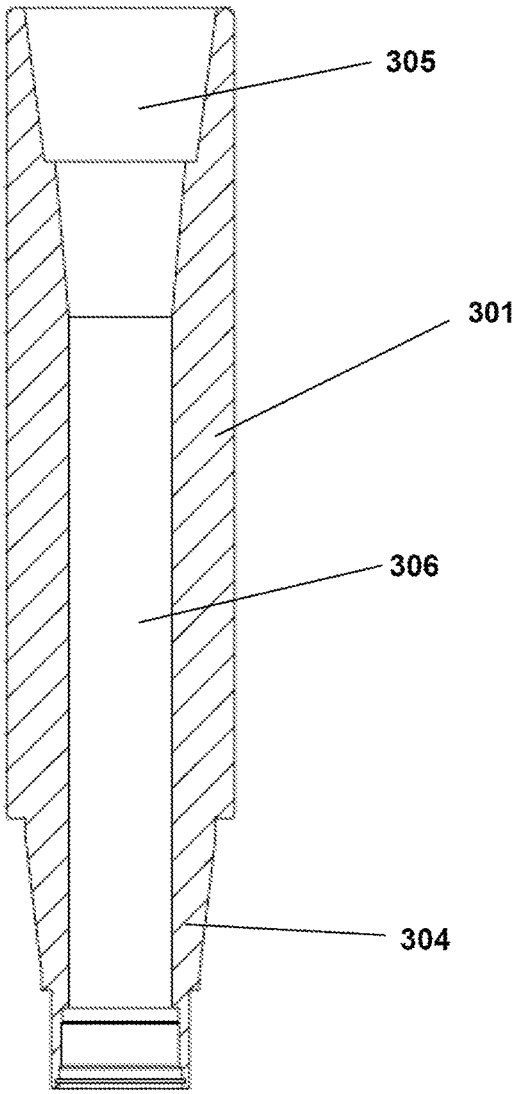

As shown in FIGS. 7*a* and 7*b*, the upper sub 301 has a generally cylindrical body, with a central passage 306 passing between the ends, the central passage axially aligned. The upper end 305 of the upper sub 301 is flared or funneled internally to receive the lower end of an adjacent element of the string. The lower end 304 is tapered to fit into the internally flared or funneled upper end of the lower sub 302. The lower end 304 is internally threaded to connect to the housing as described in detail below.

The faces of the upper and lower ends are threaded to allow the upper sub to be connected to an adjacent element (screwed together). The connection portions at the top and bottom of the sub have approved threaded drill string connections with rated torsional and axial strength—API certified drill string connections.

Lower Sub

Figures 8A, 8B:
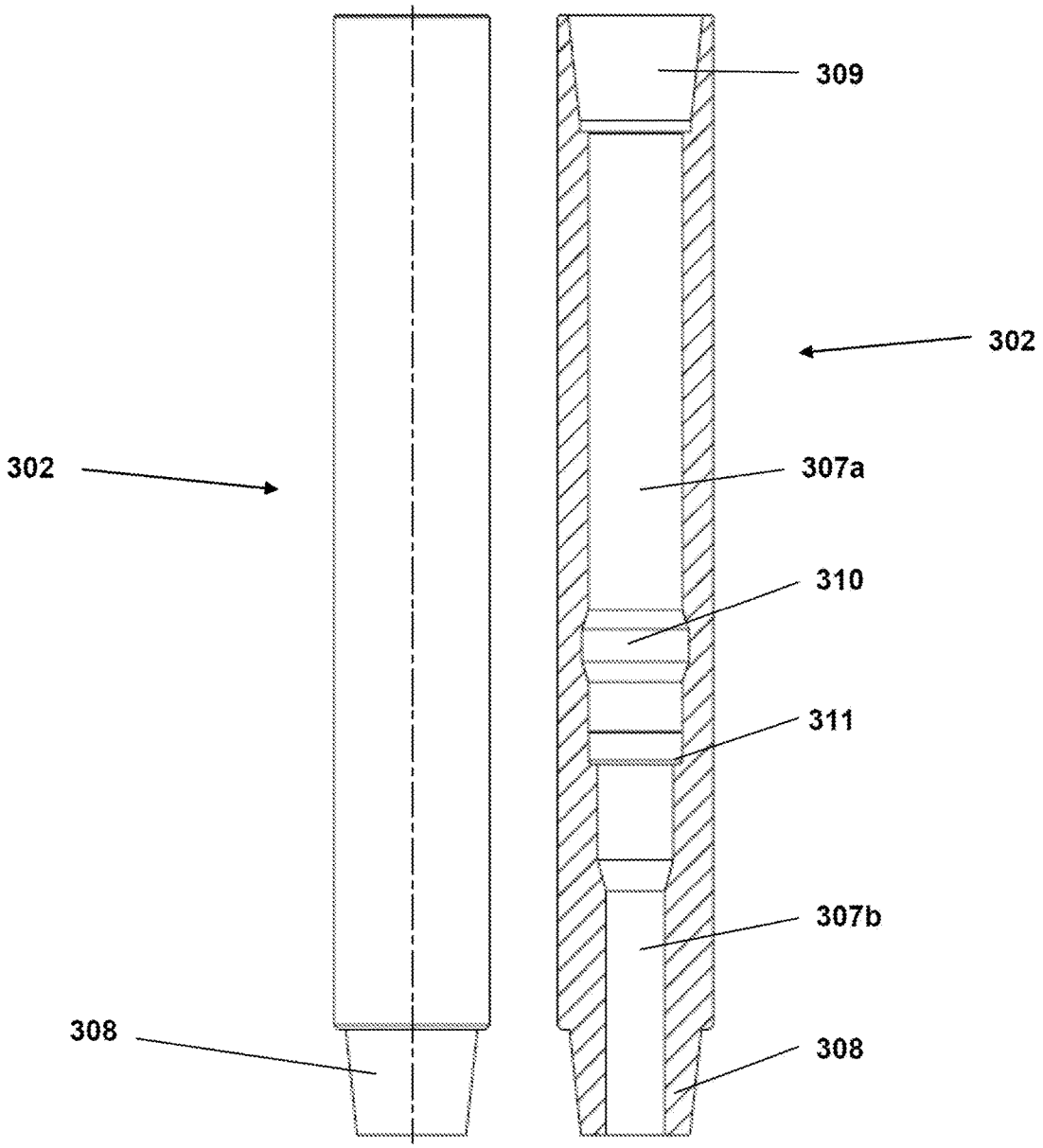
FIGS. 8*a* and 8*b* show a side view and a cutaway side view respectively of the lower sub of FIGS. 5 and 6.
Figures 9A, 9B, 9C:
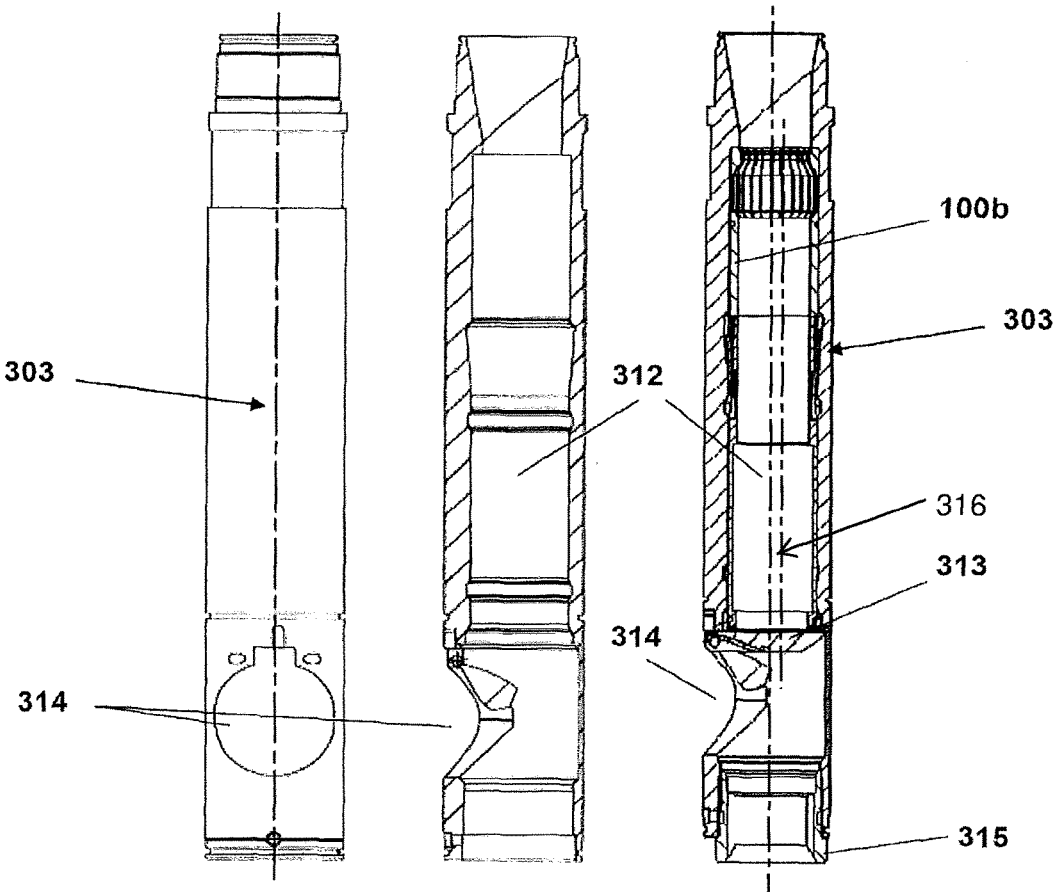
FIGS. 9*a* to 9*c* show side views of the housing of FIGS. 5 and 6, the housing having a recess into which the flapper rotates in use, the recess shown facing frontwards in FIG. 9*a* and to the left in the cutaway cross-section of FIG. 9*b*, FIG. 9*c* identical to FIG. 9*b*, but with a sliding sleeve shown located within the housing in an upper position, the sleeve moving downwards to hold the flapper open in use.

As shown in FIGS. 8*a* and 8*b*, the lower sub 302 has a generally cylindrical body, with a central passage 307 passing between the ends, the central passage axially aligned. The lower end 308 is tapered to fit into the internally flared or funneled upper end of an adjacent element of the string. The upper end 309 of the upper sub 301 is funneled internally to receive the lower end of an upwardly adjacent element of the string.

The lower and upper ends 308, 309 are threaded in a similar manner to that described above for the upper sub 301.

The central portion of the central passage 307, between the funneled ends, can be divided into two sub-sections: an upper part 307*a* and a lower part 307*b*. The upper part 307*a* has an upper end that meets with the funneled upper end 309 at the lower, narrower funnel mouth. The passage 307 then extends downwards in alignment with the centreline. A recess 310 is located approximately two-thirds of the way along (down) the length of the lower sub. The recess 310 extends around the entirety of the perimeter/internal wall of the central passage 307 and forms part of the upper part 307*a*.

The section of passage directly under the recess 310 is substantially the same diameter as the passage above the recess 310, and forms part of the upper part 307*a*. This section of the passage meets the narrower lower section 307*b* (which is also axially aligned) at an upwardly facing shoulder or ledge 311. The narrower lower part of the passage 307*b* extends below the ridge to the lower end 308, and narrows again partway along it's length. The ID (internal diameter) of the lower sub at the bottom is governed by the ID of the drill pipe that the drill string sub 300 is being used with. That is, the lower end part of the lower section 307*b* will be machined to suit, hence the small tapered section in 307*b* will also be machined to suit.

Housing

The housing 303 is generally cylindrical. The upper end of the housing 303 is sized to fit within the lower end 304 of the upper sub 301, and is externally threaded to connect to the lower end 304. The housing 303 and lower end 304 can be permanently connected via welding if necessary. However, the housing and upper sub do not have to be connected via a screw thread or similar connection. The housing could instead be held in position by the upper and lower subs 301, 302 in use. In use, the housing 303 extends from the lower end 304 of the upper sub 301 and fits snugly within the upper part 307*a* of the passage 307 of the lower sub 301.

A passage 312 runs between the upper and lower ends of the housing 303. Internally, the passage 312 is shaped and configured in a substantially identical manner to the interior passage 5 of the drill string sub 1 of the first embodiment described above between the downwardly-facing ridge or shoulder 4 and circumferential/perimetrical groove 10, including the groove 9 and expansion chamber 8. A centreline of the passage 312 is axially offset 316 towards one side of the housing 303 and a centreline of the housing.

The housing 303 contains a float valve similar to the float valve described above for the first embodiment, the float valve formed as follows. A flapper 313 is located in the passage 312 towards the lower end of the passage 312, hingedly connected to the housing 303 at one side of the passage. A recess aperture 314 is formed in the side of the passage below the flapper 313 so that the flapper can swing open downwards from the closed position where the flapper 313 extends across and closes the passage, and an open position where the flapper 313 rotates to sit within the recess aperture 314, and the recess 310 in the wall of the lower sub 302, in the manner described in detail below.

The housing 303 holds an internal sliding sleeve 100*b* within the passage 312, the sleeve 100*b* substantially identical to sleeve 100 described above. The sleeve 100*b* is able to move within the housing 303 from an upper position downwards to a lower position.

An end cap 315 screws onto the end of the housing. This prevents the sleeve from coming out the bottom of the housing during use.

In use, the sleeve 100*b* is initially located in the upper position so that the flapper 313 can freely open and close. Fluid can pass freely down the drill string through the drill string sub 300 and sleeve 100*b*. The flapper 313 activates (closes) to prevent fluid from moving up the drill string.

When it is desired to deactivate the flapper 313, the process is similar to that described above for the first embodiment. A tool such as the dart 200 shown in FIG. 4*b* is pumped down the drill string. The dart contacts the flapper 313 and holds the flapper 313 open while the sleeve 100*b* is shifted into position to hold the flapper 313 open, the dart 200 engaging with the top of the sleeve so that as pressure is maintained above the dart 200, this exerts downwards force on the sleeve 100*b*, overcoming the retaining force so that the sleeve 100 starts to move downwards.

The sleeve 100*b* can also be shifted downwards using slickline tools, if the fluid pumping method outlined above is not possible. The slickline tools cannot pass through the valve until the sleeve is shifted down, so it is not possible for the slickline tools to prematurely release from the sleeve. Coil tubing and other methods of conveying tools down a drill string can also be used as alternatives.

As described above for the first embodiment, the tool used to deactivate the float valve(s) could also be a deactivation ball, pumped down through the drill string to actuate/open the switchfloat valves in the drill string, in a similar manner to that described above for the dart 200. As described above, the deactivation ball would have a diameter slightly smaller than the internal diameter of the main part of the sleeve 100*b*, but larger than that of the upper end, so as to engage with the upper and exert downwards force on the sleeve 100*b*. After the sleeve 100*b* has moved down a certain distance, the fingers at the upper end of the sleeve 100*b* move outwards into the expansion chamber in the housing 303, allowing the ball to travel through the sleeve 100*b*, downwards through the drill string. Once the deactivation ball reaches the bottom of the drill string, it can be held in a catcher sub, or simply remain within the drill string, until tripping out of the hole. This eliminates the need to recover the actuation tool.

As previously described, a dart used with the second embodiment could be formed from a dissolvable material. The deactivation ball used with the second embodiment could also be formed from a dissolvable material.

There are several advantages to the designs described above:

Firstly, a slickline tool is not always required to be conveyed down the drill string to open the valves. This helps to reduce expense and time required to open the valves.

Secondly, spacing the flapper away from the connection allows for good strength in the connection and a larger valve ID than previous designs. For example, previous designs of valve for use with a 5-inch string have internal diameters of 1.8 inches and are actuated using shifting tools conveyed on slickline. However, the tools required to be conveyed down a 5-inch string are often larger than 1.8 inches. The new design allows an internal diameter of 2.3 inches for a 5-inch string and the valve can be deactivated using a tool that is pumped down the well. The larger ID gives the ability to utilise larger wireline tools such as 2⅛" severing charges, and heat shielded gyros. Actuating the tool no longer requires a slickline contractor and it takes significantly less time to open the valves. Ultimately the development results in significant rig time savings. The larger ID also poses less restriction to drill fluid flowing through the drill string.

The same design as outlined above can also be scaled for use in other drill string sizes.

Thirdly, it is easier to operate than previous designs. Worn parts or incorrect slickline operation pose a risk in that the slickline tools can prematurely release from the sleeve and become stuck in the float valve. Additional time consuming operations are required to remedy this situation. When using the present invention, deactivating/opening the valves does not require a skilled slickline operator.

Fourthly, when compared to standard float valves and hold open devices such as those described and shown in U.S. Pat. No. 3,318,387, for example, multiple tools may be used in series in the drill string, and one action is required to open all of the valves.

Another advantage is that the inventions allow the use of standard float valve flappers, seals and seal retaining rings. These components and this sealing system are proven to be robust and reliable, and the components are easily obtainable. Sub surface safety valves are not a practical substitute for drill string float valves for a number of reasons: Subsurface safety valves are used within a completion string, which is conveyed into the well with a rig and left in there (the rig is moved off site) to pipe produced fluid from the well. A completion string is generally quite thin walled tubing. A completion string does not require high tensional and torsional strength for drilling operations. Sub surface safety valves are also not subject to vibrations due to drilling. The sub-surface safety valves act as safety shut off valves for the well, so that the well is able to be shut in if any of the surface equipment fails. Usually a hydraulic control line connects the sub surface safety valve to surface. This allows the valve to be actuated from surface. When fluid is flowing through a sub surface safety valve the flapper is held open and protected from flow (flow is up the well not down). The sleeve is usually spring biased so that the system fails to a safe condition with the flapper closed. Fluids passing through a sub surface safety valve are generally hydrocarbons, and are generally not as corrosive or erosive as drilling fluids (or corrosive environments like high temp geothermal drilling applications). It is generally not good practise to contact the flapper of a sub surface safety valve with a wireline conveyed tool. This could damage the sealing surface or flapper. Sub surface safety valves often use custom flapper designs, with metal to metal seals that are susceptible to damage through corrosion/erosion if significant flow passes through the valve with the sleeve not protecting these components. Sub surface safety valves require a method of equalising any pressure differential across the valve to enable the flapper to open.

In contrast, float valves are primarily used in a drill string, which is required to have high tensional and torsional strength. The drilling fluid used can be corrosive, high temperature (geothermal drilling), erosive (high velocity gas or liquid with abrasive retained cuttings), clogging (LCM—Loss Circulation Material—is occasionally pumped down the drill string to stop drill fluid losses into formation, by blocking cracks and porosity in the formation being drilled through). Float valves are also subject to drill string vibration and are required to be robust. They must be able to rotate and move up and down the well as part of the drill string, and are therefore unable to be controlled by a separate hydraulic actuation line. They must also be able to withstand fluid being pumped down the drill string without the flapper and sealing elements protected from the fluid flow. Float valves used within a drill string, on a drilling rig that has the ability to pump down the drill string and equalise any pressure differential across the valve.

Standard float valves do not incorporate a sleeve and a method of holding the flapper open.

The main use for this invention is as a string float valve for underbalanced drilling applications such as air drilling, foam drilling, aerated fluid drilling, managed pressure drilling etc. When carrying out underbalanced drilling, high pressure air is pumped down the drill string. In order to break a connection at surface the pressure needs to be bled off the drill string. By having a float valve close to surface the volume of air that needs to be bled off is much smaller and the time to bleed off is significantly reduced. As the well is drilled deeper additional float valves are required to be installed to maintain a minimal bleed off volume/time. If a rig gets stuck, or wish to run wireline tools into the well for any reason, conventional float valves are a barrier. This design can assist with overcoming this issue.

While the present invention has been illustrated by the description of the embodiments thereof, and while the embodiments have been described in detail, it is not the intention of the Applicant to restrict or in any way limit the scope of the appended claims to such detail. Further, the above embodiments may be implemented individually, or may be combined where compatible. Additional advantages and modifications, including combinations of the above embodiments, will readily appear to those skilled in the art. Therefore, the invention in its broader aspects is not limited to the specific details, representative apparatus and methods, and illustrative examples shown and described. Accordingly, departures may be made from such details without departure from the spirit or scope of the Applicant's general inventive concept.

The invention claimed is:

1. A drill string float valve assembly for use with a drill string having a drilling bit at an end, the drill string float valve assembly comprising:

at least one tubular sub having an internal passage formed between two opposing ends, each end configured for connection to an end of an adjacent drill string element;

a flapper located within the at least one tubular sub, the flapper hinged to move between a closed position closing the internal passage and preventing flow moving up the drill string float valve assembly and past the flapper, and an open position;

a sliding sleeve, configured to fit within the internal passage, movable from a first position where the flapper can operate freely to a second position where the sliding sleeve holds the flapper in the open position and allows free movement of tools in both directions through the drill string float valve assembly; and a retaining device, configured to prevent a deactivation tool from passing through the sliding sleeve unless the sliding sleeve is in the second position.

2. A drill string float valve assembly as claimed in claim 1 further comprising an expansion chamber within the internal passage, the retaining device configured to provide a reduced internal passage diameter unless the sliding sleeve is in the second position, the retaining device outwardly expandable when the retaining device is aligned with the expansion chamber in the second position to at least a normal internal diameter of the sliding sleeve.

3. A drill string float valve assembly as claimed in claim 2 wherein the retaining device comprises a plurality of fingers extending from an upper end of the sliding sleeve, and inner surfaces of the plurality of fingers are configured to form a reduced internal diameter section when restrained.

4. A drill string float valve assembly as claimed in claim 2 further comprising a tubular housing configured to locate in use within the internal passage, the tubular housing having a housing passage extending therethrough, the flapper located in the housing passage towards a lower end of the housing passage, the flapper hingedly connected to the tubular housing to move between a closed position closing the housing passage and an open position, the expansion chamber located in the housing passage, the sliding sleeve locating within the tubular housing in use.

5. A drill string float valve assembly as claimed in claim 4 wherein the at least one tubular sub comprises an upper sub and a lower sub connected at their ends, the tubular housing connected with the upper sub and sized and shaped to extend within the lower sub.

6. A drill string float valve assembly as claimed in claim 4 further comprising a cap, a lower end of the tubular housing and the cap configured for mutual connection, the cap configured such that when the sliding sleeve is assembled within the tubular housing and the cap is connected to the tubular housing, the sliding sleeve cannot be removed from within the tubular housing.

7. A drill string float valve assembly as claimed in claim 4 wherein the tubular housing further comprises a recess formed to extend around substantially the entirety of an perimeter/internal wall of the housing passage, the recess sized and aligned to allow the flapper to rotate into the recess to its fully open position when the tubular housing and the at least one tubular sub are assembled.

8. A drill string float valve assembly as claimed in claim 4 wherein the sliding sleeve is configured to prevent free axial movement of the sliding sleeve in use.

9. A drill string float valve assembly as claimed in claim 8 wherein the sliding sleeve further comprises at least one locking protrusion movable between a position within and a position beyond a boundary formed by an outer surface of the sliding sleeve, the at least one locking protrusion outwardly biased.

10. A drill string float valve assembly as claimed in claim 9 wherein an inner wall between the expansion chamber and the flapper further comprises at least one groove aligned substantially perpendicularly to a centerline of the housing passage, the at least one locking protrusion engaging with the at least one groove to provide a retaining force.

11. A drill string float valve assembly as claimed in claim 10 wherein the at least one locking protrusion comprises a plurality of protrusions that form part of a spring collet configured to locate onto the tubular housing.

12. A drill string float valve assembly as claimed in claim 11 wherein the sliding sleeve comprises separate first and second sections each having an end configured for mutual connection so that the first and second sections can be connected end-to-end, each section having a flange section towards the common ends, the flange sections shaped so that the spring collet can locate securely between the flange sections.

13. A drill string float valve assembly as claimed in claim 4 wherein the housing passage is axially offset from a centerline defined by an outer surface of the tubular housing.

14. A drill string float valve assembly as claimed in claim 1 further comprising a deactivation tool having a larger portion spaced away from a lower end that has a profile larger than an internal diameter of the retaining device when restrained, the deactivation tool configured such that in use the lower end of the deactivation tool will contact the flapper and open the flapper at or before the larger portion contacts the retaining device of the sliding sleeve.

15. A drill string float valve assembly as claimed in claim 14 wherein the deactivation tool is configured to be conveyed on wireline.

16. A drill string float valve assembly as claimed in claim 1 further comprising a deactivation tool configured to be pumped down the drill string.

17. A drill string float valve assembly as claimed in claim 16 wherein the deactivation tool is formed as a ball.

18. A drill string float valve assembly as claimed in claim 16 wherein the deactivation tool is formed from a dissolvable material.

19. A drill string float valve assembly as claimed in claim 16 wherein the deactivation tool is shaped with a fishing neck to allow removal of the deactivation tool from the drill string using standard wireline tools.

20. A drill string float valve assembly as claimed in claim 1 wherein an inner wall of the internal passage further comprises at least one groove aligned substantially perpendicularly to the centerline of the internal passage.

* * * * *